US010801456B2

(12) United States Patent
Cooke

(10) Patent No.: US 10,801,456 B2
(45) Date of Patent: Oct. 13, 2020

(54) CONTROL VALVE ARRANGEMENT OF A FUEL INJECTOR

(71) Applicant: DELPHI TECHNOLOGIES IP LIMITED, St. Michael (BB)

(72) Inventor: Michael Peter Cooke, Rochester (GB)

(73) Assignee: DELPHI TECHNOLOGIES IP LIMITED (BB)

( * ) Notice: Subject to any disclaimer, the term of this patent is extended or adjusted under 35 U.S.C. 154(b) by 56 days.

(21) Appl. No.: 15/771,519

(22) PCT Filed: Oct. 18, 2016

(86) PCT No.: PCT/EP2016/074985
§ 371 (c)(1),
(2) Date: Apr. 27, 2018

(87) PCT Pub. No.: WO2017/071992
PCT Pub. Date: May 4, 2017

(65) Prior Publication Data

US 2018/0355834 A1 Dec. 13, 2018

(30) Foreign Application Priority Data

Oct. 27, 2015 (GB) ..... 1518923.6

(51) Int. Cl.
*F02M 63/00* (2006.01)
*F02M 47/02* (2006.01)
*F02M 51/06* (2006.01)

(52) U.S. Cl.
CPC ..... *F02M 63/0029* (2013.01); *F02M 47/027* (2013.01); *F02M 51/0678* (2013.01);
(Continued)

(58) Field of Classification Search
CPC ..... F02M 63/0028; F02M 63/0029; F02M 63/0026; F02M 63/0045; F02M 63/0033;
(Continued)

(56) References Cited

U.S. PATENT DOCUMENTS 4,838,233 A 6/1989 Hayashi et al.
6,152,111 A * 11/2000 Potz ..... F02M 45/12 123/467

(Continued)

FOREIGN PATENT DOCUMENTS

EP 1927748 A2 6/2008
EP 3112661 A1 1/2017

(Continued)

*Primary Examiner* — Tuongminh N Pham
(74) *Attorney, Agent, or Firm* — Joshua M. Haines

(57) ABSTRACT

A control valve arrangement includes a valve body with a filling chamber with a filling hole. A filling valve is arranged in the filling chamber for opening or closing a first fluid communication controlling filling of a first control chamber, the filling valve having a filling valve member with a moving valve seat, the filling valve member being normally biased open by a first spring. A control valve opens and closes a second fluid communication for controlling the emptying of the first control chamber, the control valve being normally biased closed by a second spring. A plug is arranged in the valve body for closing the filling chamber, the plug being provided with an opening which cooperates with the moving valve seat, the opening defining the first fluid communication between the filling chamber and the first control chamber.

14 Claims, 3 Drawing Sheets

(52) U.S. Cl.
CPC .... *F02M 63/0026* (2013.01); *F02M 63/0045* (2013.01); *F02M 2200/28* (2013.01); *F02M 2547/001* (2013.01)

(58) Field of Classification Search
CPC ..... F02M 63/0035; F02M 51/0678; F02M 47/027; F01M 2200/28; F01M 2547/001; F01M 2547/003
See application file for complete search history.

(56) References Cited

U.S. PATENT DOCUMENTS

| | | | | |
|---|---|---|---|---|
| 2001/0028005 | A1* | 10/2001 | Nagai | F02M 47/027 239/585.1 |
| 2005/0224599 | A1 | 10/2005 | Magel | |
| 2005/0224600 | A1 | 10/2005 | Brenk et al. | |
| 2013/0022484 | A1 | 1/2013 | Fuchs et al. | |
| 2015/0159607 | A1* | 6/2015 | Magel | F02M 63/0029 239/533.8 |

FOREIGN PATENT DOCUMENTS

| | | | |
|---|---|---|---|
| WO | 2005119045 | A1 | 12/2005 |
| WO | 2014000961 | A1 | 1/2014 |
| WO | 2015024692 | A1 | 2/2015 |
| WO | 2016150604 | A1 | 9/2016 |

* cited by examiner

CONTROL VALVE ARRANGEMENT OF A FUEL INJECTOR

CROSS REFERENCE TO RELATED APPLICATIONS

This application is a national stage application under 35 USC 371 of PCT Application No. PCT/EP2016/074985 having an international filing date of Oct. 18, 2016, which is designated in the United States and which claimed the benefit of GB Patent Application No. 1518923.6 filed on Oct. 27, 2015, the entire disclosures of each are hereby incorporated by reference in their entirety.

TECHNICAL FIELD

The present invention relates to fuel injector and more particularly to a control valve arrangement.

BACKGROUND OF THE INVENTION

WO2015024692 describes a fuel injector where separate control valve and filling valve are used to achieve a three way valve function in the servo of a fuel injector. A filling channel and restriction orifice feed the high pressure fuel through a passage controlled by the filling valve and opening in a needle control chamber. The area near the intersection of such passage with the valve bore is found to be a high stress zone and limits the injection pressure achievable for any given material. Pressure wave activity in such drillings has also been found to cause variability in close coupled multiple injections. Manufacturability is also limited by the long grinding quill needed to make a valve bore beyond a seat and spring.

SUMMARY OF THE INVENTION

Accordingly, it is an object of the present invention to resolve the above mentioned problems in providing a control valve arrangement of a fuel injector said arrangement comprising a valve body provided with a filling chamber in which, in use, pressurized fuel enters via a filling hole. The arrangement further comprises a filling valve arranged in said filling chamber for opening or closing a first fluid communication controlling, in use, the filling with pressurized fuel of a first control chamber. The filling valve has a filling valve member moving along a valve axis, said member having a head provided with a moving valve seat and, a stem slidably guided in a bore provided in the valve body. The filling valve member is normally biased open by a first spring.

Also, the valve arrangement is further provided with a control valve having a control valve member cooperating with an actuator for opening or closing a second fluid communication for controlling, in use, the emptying of the first control chamber, said control valve member being normally biased closed by a second spring.

The control arrangement is further provided with a seat plug arranged in the valve body for closing the filling chamber. The seat plug is provided with an opening provided with a fixed valve seat adapted to cooperate with the moving valve seat, said opening defining the first fluid communication between the filling chamber and the first control chamber. In addition to the advantages mentioned in the description, the seat plug closing the filling chamber enables to provide the filling chamber with a large opening in the valve body, large opening that is obstructed in use by the seat plug but, large opening through which tools can easily be engaged for manufacturing the filling chamber. This further enable to choose to manufacture the filling chamber with any desired shape or volume.

Also, the seat plug is further provided with the filling hole which preferred orientation is substantially parallel to the valve axis.

Also, the valve body is further provided with a section of a main feedhole extending substantially parallel to the valve axis, said main feedhole being adapted to flow pressurized fuel from upstream the valve arrangement, where is arranged a fuel inlet of the injector, into a large volume V arranged downstream the valve arrangement, said large volume being defined by an injector's nozzle body in which is slidably arranged a needle valve controlling opening and closing of spray holes. The filling hole creates a fluid communication between said large volume and the filling chamber. In other words, the filling hole and the section of the main feedhole being substantially parallel, they do not intersect, the pressurized fuel flowing through the filling hole comes from the large volume enabling a better control of pressure waves propagating in the feedhole.

Preferably, the seat plug is press fitted with interference in the filling chamber.

More precisely, a spring seat is fixed to the filling valve member, the spring seat transmitting to the filling valve member an opening force generated by the first spring. The spring seat is an annular collar fixed onto the stem of the filling valve member. The first spring is a coil spring arranged around the stem of the filling valve member and compressed between a face of the valve body and the spring seat.

The spring seat can be fixed with interference fit onto the stem of the filling valve member and/or the stem can be provided with a shoulder against which abuts the spring seat, this shoulder easing locating the seat spring over the stem.

In a specific arrangement, the filling hole is provided with a throttle orifice.

Also, the guiding bore in which the stem of the filling valve member is guided opens in a bottom wall of the filling chamber and, said bottom wall can be provided with an annular undercut forming a groove surrounding said guiding bore and defining a wall which internal face is the bore and which external face is the filling chamber. This peripheral wall enables to better control the minor fuel leakage that flows through the functional clearance set between the stem and the guiding bore. Indeed, in use, when opening the second fluid communication in order to inject fuel, the top of the guiding bore de-pressurises and, fuel may leak at low pressure through said clearance from the filling chamber, which is at high pressure toward said de-pressurized area. To minimize said leaks, the peripheral subject to inward low pressure and outward high pressure radially inwardly slightly deforms, minimizing said clearance and leakage path.

In an embodiment, this wall is conical, the thickness of the wall being thinner by the opening of the bore and enlarging as measured closer to the bottom of the groove. This conical profile, although being preferred, is not mandatory and alternative embodiments with parallel faces, stepped outer face or any other profile are also possible.

Furthermore, the second fluid communication comprises a communication channel extending from the first control chamber to a second control chamber and, an evacuation channel extending from the second control chamber to a low pressure outlet line, the control valve being arranged between the second control chamber and the low pressure outlet line.

The invention further applies to a fuel injector wherein a movable needle cooperates with a nozzle to enable or prohibit, in use, fuel injection, the needle being hydraulically piloted by a control valve arrangement made as par the preceding paragraphs.

BRIEF DESCRIPTION OF THE DRAWINGS

The present invention is now described by way of example with reference to the accompanying drawings in which.

DESCRIPTION OF THE PREFERRED EMBODIMENTS

Figure 1:
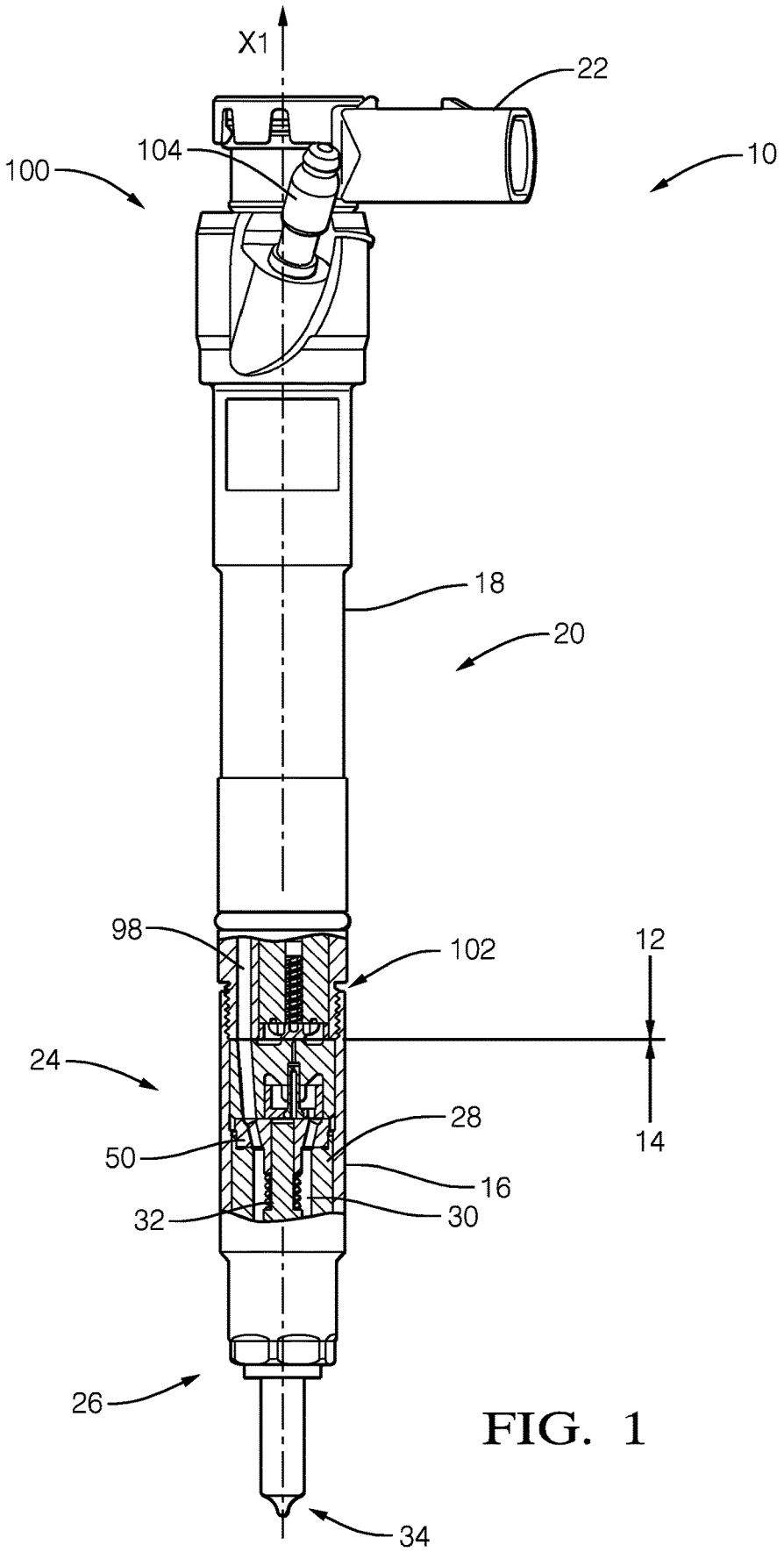
FIG. 1 is longitudinal view of a servo injector with partial section enabling to view the control valve arrangement.

In reference to FIG. 1 is described a fuel injector 10 having elongated shape generally extending along a main axis X1. The injector 10 comprises an actuation portion 12 that is on the top of the injector, as per the arbitrary and non-limiting orientation of the figure and, a hydraulic portion 14 at the bottom. The two portions 12, 14, are firmly maintained together by a capnut 16 engaged over the hydraulic portion 14 in abutment on a shoulder face and screwed on the actuation portion 12.

The actuation portion 12 comprises a body 18 provided with an actuator member 20 arranged in a bore opening in the bottom face of the actuation portion 12. An embodiment wherein the actuator member 20 is a solenoid is depicted on FIGS. 1 and 2, while an alternative with a piezo or a magneto restrictive actuator is depicted on FIG. 3. The actuator member 20 is electrically connected to an electrical connector 22 arranged on the top of the actuation portion 12.

The hydraulic portion 14 has a top face maintained in surface contact with the bottom face of the actuation portion 12 and it comprises a control valve arrangement 24 and a nozzle assembly 26.

In operation the actuator member 20 cooperates with the control valve arrangement 24 which in turn cooperates with the nozzle assembly 26 to enable or forbid fuel injection events.

The nozzle assembly 26 comprises a body 28 provided with a bore 30 in which a valve member 32, commonly identified as a needle in reference to its elongated shape, is slidably guided and cooperates with valve seating to alternatively open or close spray holes provided in the tip end 34 of the nozzle assembly 26.

The control valve arrangement 24 is arranged between the actuator portion 14 and the nozzle assembly 26 and it comprises a control valve member 36 and a filling valve member 38 cooperating with each other for together filling the function of a three-way valve. The control valve member 36 is directly actuated by the actuator member 20 while the filling valve member 38 moves as function of fuel pressure differences between a first control chamber 40 and a second control chamber 42.

Figure 2:
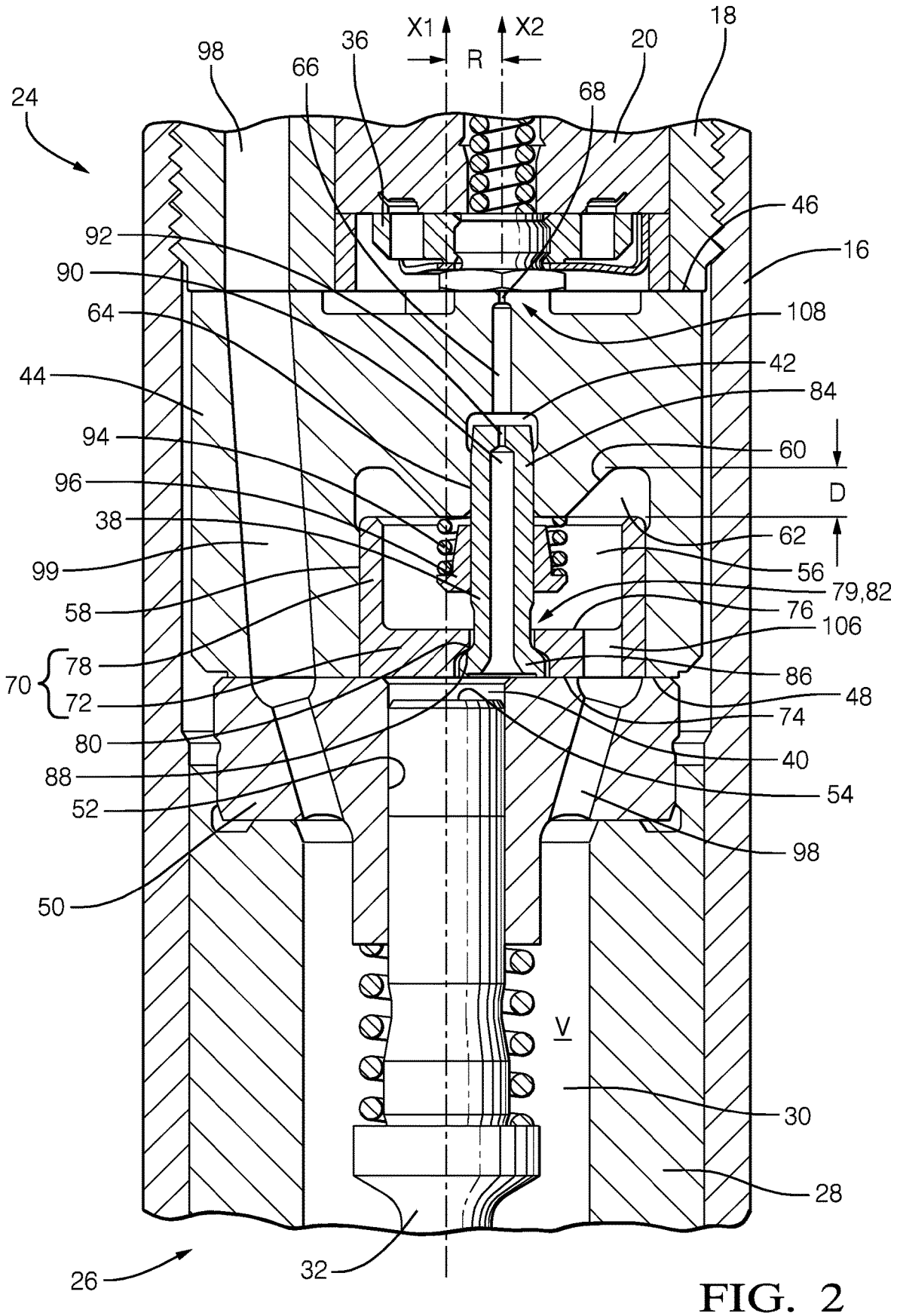
FIG. 2 is a magnified view of the control valve arrangement of the injector of FIG. 1 as per an embodiment of the invention.
Figure 3:
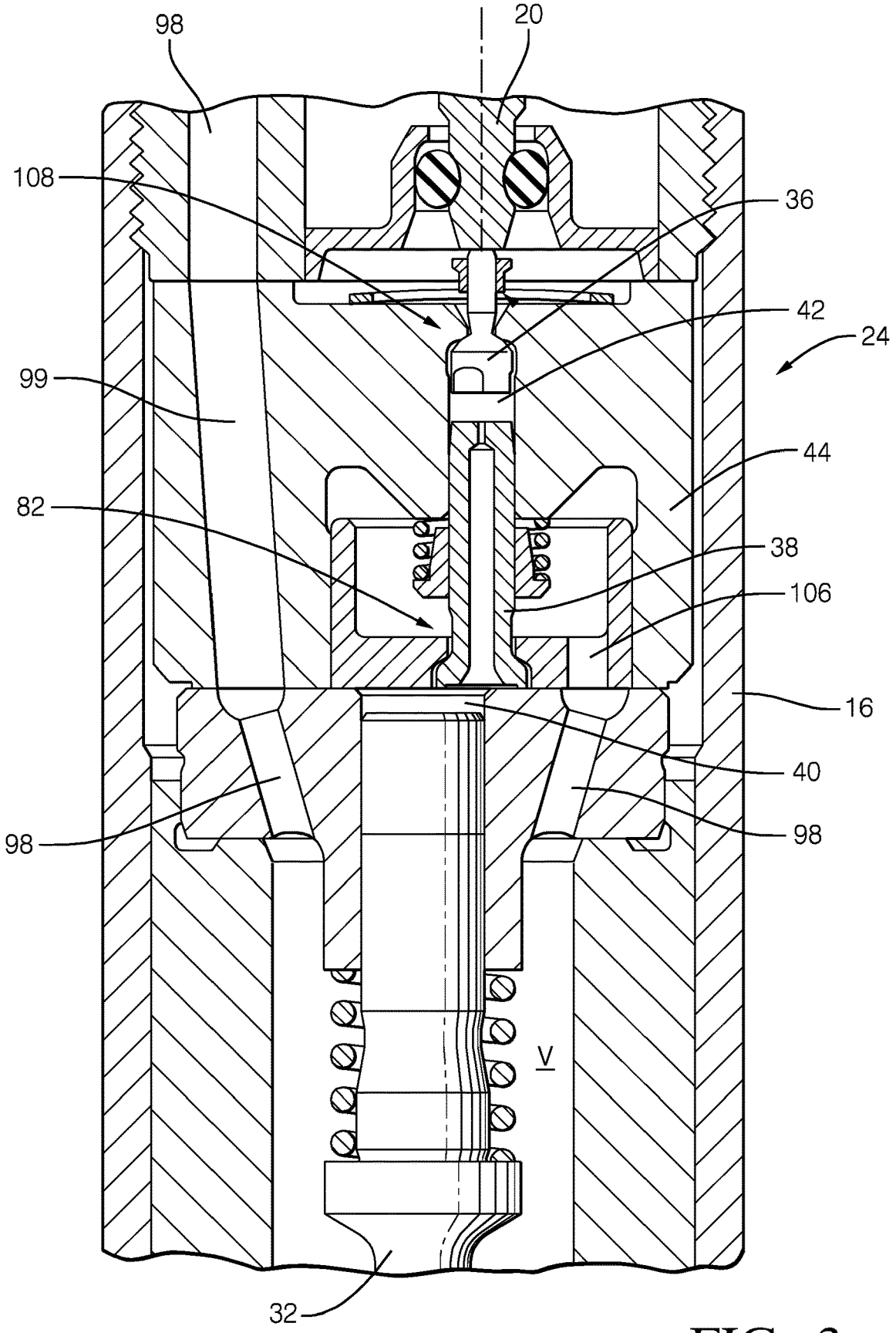
FIG. 3 is a magnified view of the control valve arrangement of the injector of FIG. 1 as per an alternative to the embodiment presented on FIG. 2.

An embodiment of the control valve arrangement 24 is now described in reference to FIGS. 2 and 3. In FIG. 2 the actuator member 20 is a solenoid and the control valve member 26 is spring guided as described in patent application GB1505004 filed 25 Mar. 2015 and, in FIG. 3 the actuator member 20 is a servo actuator, such as a piezoelectric or a magneto-restrictive, directly biasing the control valve member 36, such an arrangement of the control valve area being described in application GB1511355 filed 29 Jun. 2015.

In reference to FIG. 2, other alternatives of control valve member 36 can be arranged, for instance well-known armature-stem assembly type guided in a hydraulic bore.

In FIG. 2, the filling valve member 36 comprises a body 44 having a cylindrical shape and axially extending from a top face 46, arranged in surface contact against the bottom face of the actuation portion body 18, to a bottom face 48 arranged in surface contact against the top face of a piston guide member 50 arranged on the top of the nozzle body 28. The piston guide member 50 has an axial bore 52 wherein is slidably guided the top cylindrical portion of the needle 32, the first control chamber 40 being defined as the volume of said axial bore 52 axially comprised between the top face 54 of the needle and the bottom face 48 of the filling valve body 44.

The filling valve body 44 is provided with a cylindrical filling chamber 56 that is a cylindrical cavity having a peripheral wall 58 and a bottom wall 60. The filling chamber 56 extends along a valve axis X2 parallel to the main axis X1 and offset by radial distance R. On the bottom side, the filling chamber 56 opens in the bottom face 48 of the body 44 and, on the top side, the bottom wall 60 of the chamber 56 has a conical shape as said bottom wall 60 is provided with a peripheral annular groove 62 surrounding a conical protrusion formed at the center of said bottom wall 60.

The filling valve body 44 is further provided with a guiding bore 64 upwardly extending toward a bottom transverse face at the center of which depart an evacuation channel 66 upwardly extending along the valve axis X2. The guiding bore 64 opens in the center of the bottom wall 60 of the filling chamber, at the tip of said conical protrusion and, the evacuation channel 66, of much smaller diameter than the guiding bore 64, joins the bottom transverse face of said guiding bore 64 to the top face 46 of the filling valve body. Furthermore, the evacuation channel 66 is provided with a throttle restriction 68 arranged in the vicinity of its top end opening in the top face 46 of the body. As an alternative, the throttle restriction 68 could be arranged closer to the bottom transverse face of the guiding bore. As visible on FIG. 2 the evacuation channel 66 opens right below the control valve member 36 so that, in operation, said channel 66 is alternatively opened or closed by the control valve 36 depending whether the solenoid 20 is energized or not.

In the filling chamber 56 is arranged a cup-like seat plug 70 closing the opening of the chamber 56 in the bottom face 48 of the filling valve body. The seat plug 70 has a transverse bottom wall 72 at the circular periphery of which axially extends a peripheral wall 78. The bottom wall 72 has an under face 74 arranged flush with the bottom face 48 of the filling valve body 44 and, an opposed upper face 76 inside the chamber 56. The seat plug 70 is fixed in place in the filling chamber 56 thanks to its peripheral wall 78 that is press-fitted with interference against the cylindrical peripheral wall 58 of the filling chamber. Other fixing means such as laser welding are also possible. The bottom wall 72 of the seat plug is provided in its center with an axial X2 through opening 79 and forming a fixed filling valve seat 80 that, as visible on the figure, is aligned with the guiding bore 64. The section of the opening 79 enlarges from its opening in the upper face 76, where said section is similar, equal or slightly superior, to the section of the guiding bore 64, to its opening in the under face 78 which largely opens in the first control chamber 40 creating a first fluid communication 82 controlled by the filling valve member 38 between the first control chamber 40 and the filling chamber 56.

Over the prior art, a better control of the pressure waves propagating within the injector is achieved by having a separate press-fitted seat plug 70 closing the filling chamber 56. Indeed, the separate seat plug 70 can be accurately positioned within the filling chamber 56 and the volume of said filling chamber 56 is easily chosen over a large range, when in the prior art this volume is machined as an undercut in the body.

The poppet filling valve member 38 has a cylindrical stem 84 slidably guided in the guiding bore 64 and, a head 86 provided with a moving valve seat 88 complementary engaged in the opening 79 of the fixed valve seat 80. While the head 86 of said poppet filling valve is arranged in the thickness of the bottom wall 72 of the seat plug, the stem 84 extends in the filling chamber 56 and engages inside the guiding bore 64. As visible on the figure, the filling valve member 38 is further provided with a small annular undercut joining the stem 84 to the head 86. The second control chamber 42 is the space comprised in the guiding bore 64 above the top of the stem 84. As visible on the figure, the filling valve member 38 is provided with an internal axial communication conduit 90 opening both in the head 86, the communication conduit 90 there opening in the first control chamber 40 and, in the top of the stem opening in the second control chamber 42, the communication conduit 90 creating a permanently open fluid communication between the first 40 and the second 42 control chambers. Proximal the second control chamber 42, the communication conduit 90 is provided with another throttle restriction 92 which alternatively could be arranged proximal the head 86 or anywhere intermediate the head and the top of the stem 84.

Coming back to the annular groove 62 provided at the bottom of the filling chamber, one can visualize that said groove is substantially of the same axial depth D than the guiding length of the stem 84 inside the guiding bore 64 therefore, the conical protrusion creates a wall surrounding the guiding bore 64, said wall having an increasing section as said section is measured closer to the top of the figure. The filling valve member 38 is downwardly biased open, in an open position OP of the filling valve seats 80, 88, by a coil spring 94 arranged around the stem 84 and compressed between the bottom wall 60 of the filling chamber and a spring seat 96 fixed to the stem 84. The spring seat 96 is a collar-like member engaged onto the stem 84 and maintained in position either because of press-fitting engagement with interference with the stem 84 or, because of a small shoulder face provided on the stem, the spring seat abutting against said shoulder face.

In the prior art, the head 86 of the filling valve member serves the function of a sealing area with the fixed seating seat, and also the function of a spring seat for the spring 94 to transmit an opening force onto the valve member 38. The sealing area and the spring seat area are concentrically arranged on the head 86 obliging said head 86 and the opening 79, through which extends the filling valve member, to be large enough to have the spring 94 passing through the opening 79 and be in contact with the head 86. Having coaxial rather than concentric arrangement enables to separate the functions, the sealing area remaining alone on the head 84. Therefore, the section of the opening 79 can be limited to the sealing function and consequently, said opening 79 can be of the same dimensions as the guiding bore 64, sufficient to enable the stem 84 to be engaged through said opening 79, the undercut ensuring a sufficient operational clearance between the valve member and the seat plug. The person skilled in the art will understand that the same dimensions take into account the necessary manufacturing tolerances, ensuring that the stem 84 must be able to freely translate without difficulty through the opening 79, the opening 79 having dimensions slightly superior to the dimensions of the stem 84.

The fuel injector is further provided with a high pressure fuel circuit 98 and also with a return circuit 100. The high pressure fuel circuit 98 comprises a main feedhole having several sections, said main feedhole conveying pressurized fuel from a fuel injector inlet 100 to the spray holes arranged in the tip 34 of the nozzle and also to, the first control chamber 40. The return circuit 102 also comprises several portions for emptying said first control chamber 40 and directing the return fuel toward an injector outlet 104.

A section 99 of the main feedhole extends through the filling valve body 44 and continues in another section through the piston guide member 50 where the feedhole opens in a large volume V inside the nozzle body 28. In the valve body 44, the section 99 extends substantially parallel to the valve axis X2. Another channel portion arranged through the piston guide member 50 enables pressurized fuel to move back up toward the seat plug 70 where a filling hole 106 is provided through the bottom wall 72 of the seat plug, thus enabling pressurized fuel to enter the filling chamber 56. In the preferred embodiment represented on the figure, the filling hole 106 is axially oriented, while in alternatives it could also be pierced at an angle. In the prior art, said filling hole intersects with the valve axis X2. An advantage of said preferred embodiment is that said axial orientation of the filling hole 106, which does not intersect with the valve axis X2, reduces the mechanical stresses in this high stress zone identified in the prior art, the stress reduction enabling increase in injection pressure achievable.

Furthermore, it is known that pressure waves propagate in the main high pressure feedhole, drawn on the left of the figure and, the location and orientation of the filling hole 106 connecting the filling chamber 56 to the volume V, and not to said main high pressure feedhole, enables further control and reduction of the pressure waves.

In an alternative not represented, a throttle orifice restricting the channel section can be arranged in the filling hole 106 or in the piston guide member 50.

The major operational steps of this control valve arrangement 24 are now described.

In operation, when arranged in fuel injection equipment, fuel at high pressure enters via the inlet 100 and fills the high pressure circuit 98. The principles of operation of the fuel injector 10 are similar to the description provided in application WO2015024692, said principles being briefly detailed here below.

In a first phase the injection of fuel is prohibited since the needle 32 is in a closed position in complementary abutment against a seating face of the nozzle body 28 preventing access to the spray holes. The solenoid 20 is not electrically energized and therefor the control valve member 36 is biased in a closed position of a second fluid communication 108 that is between the second control chamber 42 and the drain. The evacuation channel 66 is than closed preventing exit of fuel from the first 40 and second 42 control chambers and enabling pressure increase in said control chambers. The filling valve member 38 is biased in an open position by the spring 94 and also under the influence of the fuel pressure in the filling chamber 56. The first fluid communication 82 is than open between the high pressure circuit 98 and the first control chamber 40 wherein pressure raises and maintains the needle 32 in the closed position.

In a second phase an injection event is initiated by energizing the solenoid 20 which generates a magnetic field upwardly attracting an armature and therefore opening the evacuation channel 66 and the second fluid communication 108. The high pressure fuel inside the first control chamber 40 flows out into the second control chamber 42 wherefrom it continues in the return circuit 102 toward a low pressure reservoir. Thanks to the small volume of the second control chamber 42, the opening of the evacuation channel 66 creates a sudden drop of pressure upwardly aspiring the filling valve member 38 that moves in a closed position of the first fluid communication 82 forbidding the entry of high pressure fuel in the first control chamber 40.

In a third phase the injection event started above is ended by stopping to energize the solenoid 20. The control valve member 36 is biased back toward closing the second fluid communication 108 and the evacuation channel 66 and, similarly to the first phase, the pressure rises again in the control chambers 40, 42 forcing the needle 32 toward the closed position.

LIST OF REFERENCES

X1 main axis
X2 valve axis
R offset between main and valve axes
D depth of the groove
OP open position of the filling valve
V volume
10 injector
12 actuation portion
14 hydraulic portion
16 capnut
18 body of the actuation portion
20 actuator member
22 electrical connector
24 control valve arrangement
26 nozzle assembly
28 nozzle body
30 bore
32 valve member-needle
34 tip end of the nozzle
36 control valve member
38 filling valve member
40 first control chamber
42 second control chamber
44 filling valve body
46 top face of the filling valve body
48 bottom face of the filling valve body
50 piston guide member
52 axial bore in the piston guide
54 top face of the needle
56 filling chamber
58 peripheral wall of the filling chamber
60 bottom wall of the filling chamber
62 annular groove
64 guiding bore
66 evacuation channel
68 throttle restriction
70 seat plug
72 bottom wall of the seat plug
74 under face of the bottom wall of the seat plug
76 upper face of the bottom wall of the seat plug
78 peripheral wall of the seat plug
79 opening in the bottom wall of the seat plug
80 fixed filling valve seat
82 first fluid communication
84 stem
86 head
88 moving valve seat
90 communication conduit
92 throttle restriction
94 spring
96 spring seat
98 high pressure fuel circuit
99 main feedhole
100 injector inlet
102 return circuit
104 injector outlet
106 filling hole
108 second fluid communication

The invention claimed is:

1. A control valve arrangement of a fuel injector, the control valve arrangement comprising:

a valve body provided with a filling chamber in which pressurized fuel enters via a filling hole;

a filling valve arranged in the filling chamber for opening or closing a first fluid communication which controls filling with pressurized fuel of a first control chamber, the filling valve having a filling valve member moving along a valve axis, the filling valve member having a head provided with a moving valve seat and a stem slidably guided in a bore provided in the valve body, the filling valve member being normally biased open by a first spring;

a control valve having a control valve member cooperating with an actuator for opening or closing a second fluid communication which controls emptying of the first control chamber, the control valve member being normally biased closed by a second spring; and a seat plug arranged in the valve body which closes the filling chamber, the seat plug being provided with an opening provided with a fixed valve seat which cooperates with the moving valve seat, the opening defining the first fluid communication between the filling chamber and the first control chamber;

wherein the seat plug is press fitted with interference within the filling chamber.

2. A control valve arrangement as claimed in claim 1, wherein the seat plug is further provided with the filling hole.

3. A control valve arrangement as claimed in claim 1, wherein an orientation of the filling hole is parallel to the valve axis.

4. A control valve arrangement as claimed in claim 1, wherein the valve body is further provided with a section of a main feedhole extending axially, the main feedhole being adapted to flow pressurized fuel from upstream of the control valve arrangement into a volume arranged downstream of the control valve arrangement, the filling hole creating fluid communication between the volume to the filling chamber.

5. A control valve arrangement as claimed in claim 1, further comprising a spring seat fixed to the filling valve member, the spring seat transmitting to the filling valve member an opening force generated by the first spring.

6. A control valve arrangement as claimed in claim 5, wherein the spring seat is an annular collar fixed onto the stem of the filling valve member, the first spring being a coil spring compressed between a face of the valve body and the spring seat.

7. A control valve arrangement as claimed in claim 6, wherein the spring seat is fixed with interference fit onto the stem of the filling valve member.

8. A control valve arrangement as claimed in claim 6, wherein the stem is provided with a shoulder against which abuts the spring seat.

9. A control valve arrangement as claimed in claim 1, wherein the filling hole is provided with a throttle orifice.

10. A control valve arrangement as claimed in claim 1, wherein the bore in which the stem of the filling valve member is guided opens in a bottom wall of the valve body into the filling chamber.

11. A control valve arrangement as claimed in claim 10, wherein the bottom wall of the valve body is provided with an annular undercut forming a groove surrounding the bore and defining a wall with an internal face which is the bore and with an external face which is the filling chamber.

12. A control valve arrangement as claimed in claim 11, wherein the external face of the wall is conical, a thickness of the wall being thinner by an opening of the bore and enlarging as measured closer to a bottom of the groove.

13. A control valve arrangement as claimed in claim 1, wherein the second fluid communication comprises a communication channel extending from the first control chamber to a second control chamber and, an evacuation channel extending from the second control chamber to an outlet line, the control valve being arranged between the second control chamber and the outlet line.

14. A fuel injector comprising:

a movable needle which cooperates with a nozzle to enable or prohibit fuel injection; and a control valve arrangement which hydraulically pilots the movable needle, the control valve arrangement comprising:

a valve body provided with a filling chamber in which pressurized fuel enters via a filling hole;

a filling valve arranged in the filling chamber for opening or closing a first fluid communication which controls filling with pressurized fuel of a first control chamber, the filling valve having a filling valve member moving along a valve axis, the filling valve member having a head provided with a moving valve seat and a stem slidably guided in a bore provided in the valve body, the filling valve member being normally biased open by a first spring;

a control valve having a control valve member cooperating with an actuator for opening or closing a second fluid communication which controls emptying of the first control chamber, the control valve member being normally biased closed by a second spring; and a seat plug arranged in the valve body which closes the filling chamber, the seat plug being provided with an opening provided with a fixed valve seat which cooperates with the moving valve seat, the opening defining the first fluid communication between the filling chamber and the first control chamber;

wherein the seat plug is press fitted with interference within the filling chamber.

* * * * *